United States Patent [19]

Thompson

[11] 4,019,735

[45] Apr. 26, 1977

[54] FOOTBALL KICKING TEE WITH VACUUM BALL RETAINER

[76] Inventor: James E. Thompson, 4201 Don Tomaso Drive, Los Angeles, Calif. 90008

[22] Filed: July 21, 1975

[21] Appl. No.: 597,486

[52] U.S. Cl. ..... 273/55 B; 273/DIG. 24; 248/362; 248/363

[51] Int. Cl.[2] ..... A63B 67/00

[58] Field of Search ..... 273/55 R, 26 E, 184 B, 273/95 A, 33, DIG. 24, 55 B, 26 R; 248/362, 363; 279/3; 269/21; 51/235; 124/41 R; 46/32

[56] References Cited

UNITED STATES PATENTS

| | | | |
|---|---|---|---|
| 2,596,811 | 5/1952 | Carlson | 248/363 X |
| 2,701,723 | 2/1955 | Ekberg | 279/3 |
| 3,087,726 | 4/1963 | Pogue | 273/55 B |
| 3,167,326 | 1/1965 | Heessels | 248/363 X |
| 3,309,087 | 3/1967 | Cullity | 273/55 B |

*Primary Examiner*—Richard C. Pinkham
*Assistant Examiner*—T. Brown
*Attorney, Agent, or Firm*—William P. Green

[57] ABSTRACT

A tee for holding a football in kicking position and including suction means for retaining the ball against dislocation from the tee by wind or the like, with the suction means preferably including a motor driven blower contained in the tee and creating a vacuum effect at several locations of contact with the ball.

12 Claims, 5 Drawing Figures

FOOTBALL KICKING TEE WITH VACUUM BALL RETAINER

BACKGROUND OF THE INVENTION

This invention relates to an improved tee device for supporting a football in kicking position.

During each 'kick-off' in a football game, the ball is supported on a portable tee device which is temporarily placed at the proper location on the playing surface, and is constructed to hold the ball at a proper inclination to be effectively place-kicked toward the opposite goal line. A similar tee may be employed for holding the ball when kicking a field goal or point after touchdown. Structurally, a tee used for any of these purposes may be shaped to have an upwardly concave configuration, or its equivalent, adapted to receive and position a lower portion of the ball while leaving the main body of the ball accessible for kicking and free for movement off of the tee when kicked. Various different designs of tee have been proposed in the past in attempting to improve the functional characteristics of the tee, and some of these prior arrangements have been covered by patents, such as for example U.S. Pat. Nos. 3,087,726, 3,309,087, 3,481,602, 3,516,667 and 3,662,728.

One problem which is encountered in using conventional tees resides in their inability to effectively retain the ball in proper position on the tee under windy or gusting conditions. It frequently happens under such conditions that after both teams have lined up for a kick-off, and perhaps even after the kicker has commenced his approach toward the ball, a sudden gust of wind may blow the ball off of the tee, or change its position on the tee sufficiently to adversely affect the direction or distance that the ball is kicked. Even though the displacement may in some cases be relatively small and perhaps unnoticed, the slight dislocation of the ball from a desired precisely proper orientation with respect to the tee may result in a very poor kick and loss of yardage or points by the kicking team.

SUMMARY OF THE INVENTION

A major purpose of the present invention is to provide an improved tee structure which overcomes the above discussed disadvantage of prior tees, and in particular which retains a ball in accurately set position on the tee with sufficient force to prevent its accidental dislocation by wind gusts or any other displacing force. To achieve this purpose, I provide the tee with suction means, which act by suctional attraction to hold the ball against the tee. At the same time, however, this suctional force is sufficiently light and so directed as to leave the ball free for movement off of the tee when kicked.

The suctional effect is desirably attained by providing within the interior of the portable tee an air moving unit, that is, an appropriate blower or fan, which takes suction from a location adjacent a surface of the football to produce a subatmospheric pressure or partial vacuum at that location acting to attract the ball surface to the tee. Desirably, the blower produces a suction of this type at a plurality of different locations of contact with the ball, typically three such locations. Deformable seal means may be provided at each of these locations, to contact the ball surface in a manner forming a seal about the vacuum location and thereby maximize the suction effect. For this purpose, suction cup type devices may be employed as the sealing means. A motor located within the tee may drive the air moving unit, and be energized by a battery or batteries also located within the tee.

An additional object of the invention is to provide improved means for assisting the kicker in aiming his kick, by giving him a visible point of aim on the tee to view as he approaches for the kick. More particularly, I provide the tee with an electrically energized light element, desirably located at the back side of the tee and directly beneath the center of the ball, to indicate visibly the proper vertical central plane within which the kicking foot should move. A single on-off switch may control both this lamp and the suction creating blower.

BRIEF DESCRIPTION OF THE DRAWING

The above and other features and objects of the invention will be better understood from the following detailed description of the typical embodiment illustrated in the accompanying drawing in which.

DESCRIPTION OF THE PREFERRED EMBODIMENT

Figure 1:
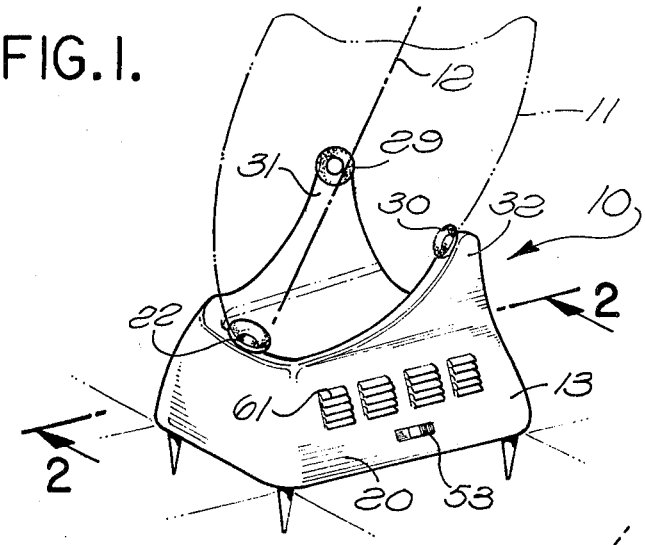
FIG. 1 is a perspective view of a football kicking tee constructed in accordance with the invention.

There is illustrated at 10 in the figures a kicking tee which is adapted to support a football 11 in an upstanding position in which the longitudinal axis 12 of the ball is inclined at an appropriate angle for kicking. The tee 10 includes a hollow body 13, preferably formed of high impact essentially unbreakable resinous plastic material, and adapted to be removably positioned at an appropriate kicking location on a ground surface 14 or other playing surface. The undersurface 15 of bottom wall 115 of body 13 may be planar to extend horizontally above ground surface 14, and may have a number of downwardly projecting parallel sharp spikes 16 adapted to project into the earth or other playing surface material to effectively retain the tee in fixed position on that surface. In the particular arrangement illustrated in the figures, the undersurface 15 is generally rectangular, and has four of the locating spikes 16 at its four corners. At its upper side, body 13 has an upwardly facing top wall 17 above which the football is located, with the top and bottom walls being joined by front and rear walls 18 and 19, and opposite side walls 20, all merging together to extend continuously about the body.

The front portion of surface 17 may curve slightly upwardly as illustrated at 21, and carry a seal element 22 for engaging and supporting the lower tip portion 23 of the ball. This seal element 22 is adapted to annularly engage and form an airtight seal with the surface of the ball at its lower tip end, and may for this purpose take the form of essentially a suction cup element formed of resiliently deformable rubber or other similar elastic material. This cup 22 engages the surface of the ball along the annular periphery 24 of the cup, and has a central opening 25 through which air is withdrawn from the space 26 within the suction cup and between it and the ball to keep the ball in contact with the cup by suction effect. The cup may be secured in position on top wall 17 by reception of an annular edge 27 of the body material within an annular groove 28 formed in the periphery of the suction cup element, between its outer cup portion and a flange 122 (see FIG. 2).

Two additional suction cup elements 29 and 30, which may be identical with element 22, are carried by two hollow upwardly projecting laterally spaced rear post portions 31 and 32 of body 13. These two sealing elements 29 and 30 are engageable with the back of the ball near its opposite sides in supporting relation, to coact with cup 22 in holding the ball in the illustrated inclined position. The elements 29 and 30 face inwardly at angles causing their peripheries to engage the corresponding ball surfaces annularly to seal the space within the cups and communicating with openings 33 formed in the centers of the cups. The cup elements 29 and 30 are secured to the upwardly projecting portions 31 and 32 of the body by reception of annular edges formed by the body material within grooves in the cups corresponding to the groove 28 of FIG. 2.

Air is drawn from the interior of the three suction cups 22, 29 and 30 by an air moving unit 34, typically taking the form of a rotary centrifugal blower as shown, or an axial flow fan if desired. This blower 34 may include an outer housing 35 containing a rotor 36 driven about a horizontal axis 37 by a connected motor 38. The inlet to the blower may be a fitting 39, having three branches 40, 41 and 42 connecting to three hoses 43, 44 and 45 leading to the three suction cups respectively. The suction cups may have inner tubular portions 46 connected to the hoses by rigid connector tubes 47 each of which has its opposite ends connected into one of the suction cups and one of the hoses, with clamps 49 being received about the connected flexible tubes to tighten them against the inner rigid elements 47.

The motor 38 and blower 34 are suitably secured in fixed positions within the tee body, as by screws 50 attaching the motor and blower to a removable closure section 48 of bottom wall 115, with closure 48 typically being retained by additional screws 148. A battery or series of batteries illustrated diagrammatically at 51 is contained within the hollow body, and energizes the motor under the control of a switch 52 actuable by a manually operated control member 53 accessible from the outside of the tee.

Figure 5:
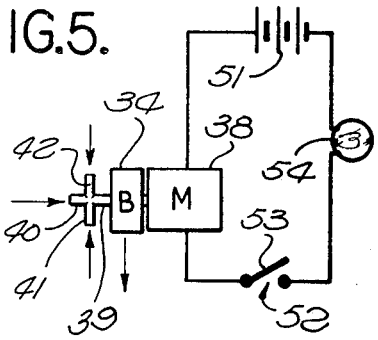
FIG. 5 is a somewhat diagrammatic representation of the blower system and electrical circuit of the device.
Figure 3:
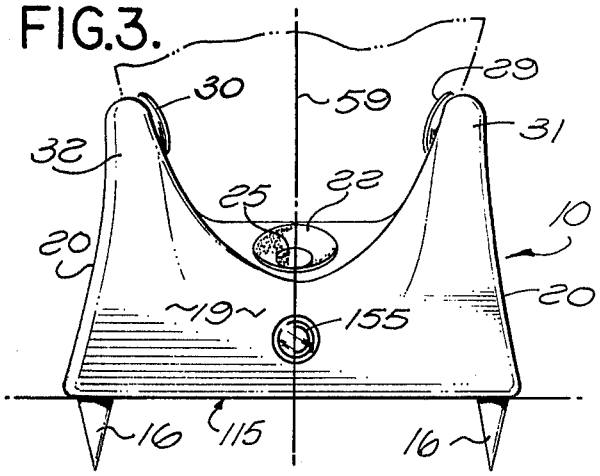
FIG. 3 is a reduced scale rear view taken on line 3—3 of FIG. 2.
Figure 4:
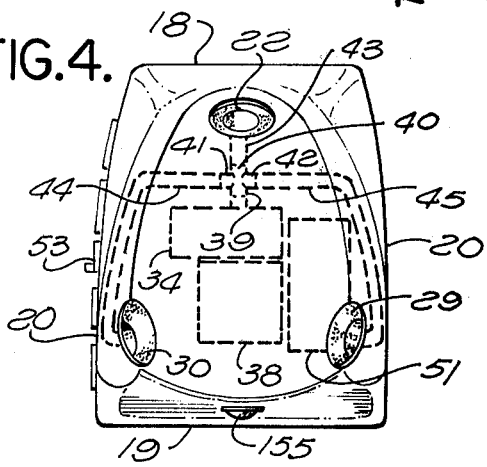
FIG. 4 is a plan view of the tee.

A light bulb 54 is mounted to the rear wall 19 of the body and projects rearwardly through an opening 55 in that wall, protected by an unbreakable transparent cover 155, with the inner threaded end 56 of the bulb being screwed into a socket 57 secured by fasteners 58 to the inner side of wall 19. As seen in FIG. 3, this bulb 54 is located within the vertical central plane 59 of the tee and ball, and directly beneath the center of the back side of the ball, to be viewed by a kicker as an indication of the exact positioning of the ball as he approaches the tee and ball. The light bulb 54 is connected into the switch controlled circuit from battery 51 in series with the motor (FIG. 5).

Figure 2:
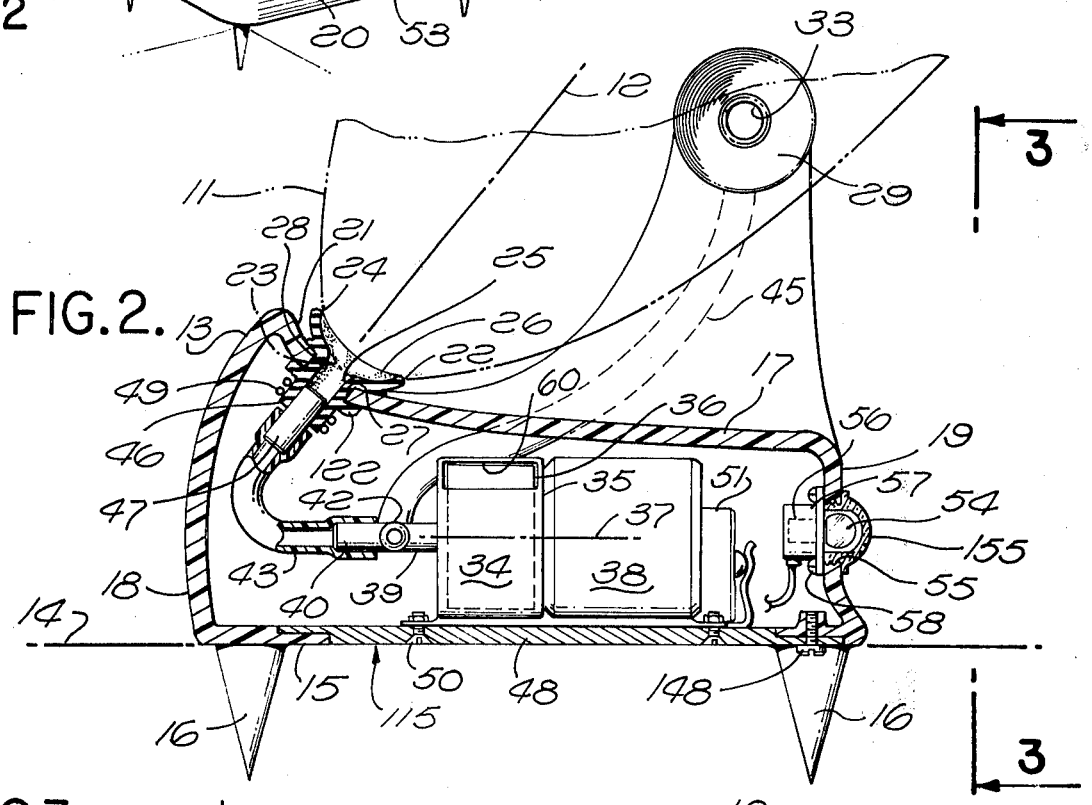
FIG. 2 is an enlarged central vertical section taken primarily on line 2—2 of FIG. 1.

In using the illustrated tee, the first step is to place the tee at the desired kicking location on the ground surface 14, in the position illustrated in FIG. 2, with the front to rear vertical central plane 59 aiming in the direction in which the kick is to be made. With the tee properly positioned, the player actuates switch 52 by its control element 53, to energize motor 38 and light bulb 54. He then places the ball 11 on the tee as shown, so that all three of the suction cups 22 peripherally engage the surface of the ball about an area within which a suction is then created by blower 34. The air drawn from these suction cups is emitted from the blower housing through an outlet opening 60, and then discharges from the hollow body 13 through appropriate openings 61 formed in one or more of the walls of that body, typically the side walls as shown in FIG. 1. The suction effect is great enough to hold the ball very effectively in position on the tee by suction, with a force sufficient to resist unwanted dislocation of the ball relative to the tee by gusts of wind or the like. The ball is therefore in very accurately predetermined position when kicked, to maximize the chances of a properly directed and long kick. As the kicker approaches the tee, he may keep his eye on and aim toward the light bulb 54, and attempt to kick the ball at a location just above that bulb and in the same vertical front to rear plane 59 as the bulb. As soon as the ball has been kicked, it moves away from the suction cups and immediately breaks the suction effect to free the ball for flight through the air without restraint.

While a certain specific embodiment of the present invention has been disclosed as typical, the invention is of course not limited to this particular form, but rather is applicable broadly to all such variations as fall within the scope of the appended claims.

I claim:

1. A football kicking tee comprising:

a support structure adapted to receive a football and support it in an upstanding kicking position from which it is to be kicked by a player;

said structure including suction means for retaining the ball by suction against accidental dislocation from said kicking position;

said structure including a hollow body having an upwardly facing surface and two laterally spaced support posts projecting upwardly above said surface;

said suction means including three openings formed in said upwardly facing surface and said posts respectively at locations to be received opposite different portions of the football, an air moving unit contained within said hollow body and adapted to create flows of air from said three openings to retain the ball by suction, a motor within said hollow body for driving said air moving unit, and a battery within said body for energizing said motor.

2. A football kicking tee as recited in claim 1, including three elastically deformable seal elements carried by said upwardly facing surface of the body and said posts respectively for engaging the surface of the football about said openings in sealing relation.

3. A football kicking tee comprising:

a portable body adapted to be removably placed on and be supported by the playing surface of a football field;

a football holding structure carried by said body and constructed to engage a football and support it in an upstanding kicking position at approximately the level of said playing surface of a field on which the body is placed, and in a relation enabling a player running along said surface to kick the ball as he runs;

said holding structure including suction means carried by said body for retaining the ball by suction against accidental dislocation from said kicking position.

4. A football kicking tee as recited in claim 3, in which said suction means include an air moving unit carried by said portable body for producing a flow of air creating a suction effect retaining the ball in said kicking position.

5. A football kicking tee as recited in claim 3, in which said suction means include an air moving unit carried by said portable body for producing a flow of air creating a suction effect retaining the ball in said kicking position, and powered motor means carried by said body for driving said air moving unit.

6. A football kicking tee as recited in claim 3, in which said suction means include an air moving unit carried by said portable body for producing a flow of air creating a suction effect retaining the ball in said kicking position, motor means carried by said body for driving said air moving unit, and electric battery means carried by said body energizing said motor means.

7. A football kicking tee as recited in claim 3, in which said suction means include resilient sealing means engageable with a surface of the football in sealing relation about a location at which suctional retaining force is exerted against the football.

8. A football as recited in claim 3, in which said suction means include a flexible suction cup carried by said portable body and engageable with a surface of the football about a location at which suctional retaining force is exerted against the ball.

9. A football kicking tee as recited in claim 3, in which said suction means are constructed to exert suctional retaining force against the surface of the football at a plurality of spaced locations.

10. A football kicking tee as recited in claim 3, in which said suction means include resilient seal means carried by said body and engageable with a surface of the football about a predetermined location, an air moving unit carried by said body for withdrawing air from said location, and a power energized motor carried by said body for driving said air moving unit.

11. A football kicking tee as recited in claim 3, in which said football holding structure includes two support posts projecting upwardly from said body at laterally spaced locations, said suction means including two suction openings carried by said support posts respectively, and air moving means carried by said body for creating flows of air through said two openings to retain the ball by suction at two different locations.

12. A football kicking tee as recited in claim 3, in which said football holding structure includes two support posts projecting upwardly from said body at laterally spaced locations, said suction means including an air moving unit creating a flow of air through an opening forwardly of said posts to retain the ball by suction at that location.

* * * * *